US006073413A

United States Patent [19]

Tongiatama

[11] Patent Number: 6,073,413

[45] **Date of Patent: *Jun. 13, 2000**

[54] STRUCTURAL BRACING FOR BUILDINGS

[76] Inventor: Paul P. Tongiatama, 19 Redruth Road, Alexandra Hills, 4161, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/670,500

[22] Filed: Jun. 26, 1996

[51] Int. Cl.[7] ..... E04C 3/16

[52] U.S. Cl. ..... 52/693; 52/695

[58] Field of Search ..... 52/693, 694, 695, 52/729.2, 729.4, 729.1, 656.8, 407.3, 481.1, 481.2, 637, 638, 790.1, 795.1

[56] References Cited

U.S. PATENT DOCUMENTS

| | | | |
|---|---|---|---|
| 390,732 | 10/1888 | Weston | 52/695 |
| 1,622,962 | 3/1927 | Michod | 52/693 |
| 2,191,804 | 2/1940 | O'Malley | 52/693 |
| 3,612,291 | 10/1971 | Skubic | 52/637 X |
| 4,366,659 | 1/1983 | Jensen | 52/693 |
| 4,435,932 | 3/1984 | Seaburg et al. | 52/694 X |
| 4,648,216 | 3/1987 | Reaves et al. | 52/693 X |
| 5,218,803 | 6/1993 | Wright | 52/664 X |
| 5,617,693 | 4/1997 | Hefner | 52/693 |
| 5,657,606 | 8/1997 | Ressel et al. | 52/481.1 X |
| 5,664,388 | 9/1997 | Chapman et al. | 52/653.1 |
| 5,729,950 | 3/1998 | Hardy | 52/693 |

FOREIGN PATENT DOCUMENTS

| | | | |
|---|---|---|---|
| 228186 | 4/1960 | Australia | 52/656.8 |
| 3208936 | 9/1991 | Japan | 52/481.1 |

*Primary Examiner*—Richard Chilcot
*Attorney, Agent, or Firm*—Christie, Parker & Hale, LLP

[57] ABSTRACT

A truss-like brace assembly for a wall of a building has a peripheral frame defined by a pair of stiles, a top member and a bottom member, where diagonal braces and horizontal cross-braces triangulate the frame. The brace assembly is close fit in a cavity in the wall (10, 110) and the stiles, top member and bottom member are fixed to the adjacent studs, top wall plate and bottom plate to provide structural bracing in the longitudinal plane of the wall.

7 Claims, 1 Drawing Sheet

STRUCTURAL BRACING FOR BUILDINGS

FIELD OF THE INVENTION

This invention relates to structural bracing for buildings. More particularly, the invention is suitable for, but not limited to, the structural bracing of timber-or steel-framed walls.

BACKGROUND OF THE INVENTION

The various State building codes specify the minimum allowable standards for bracing. For example, buildings under some codes must be able to withstand certain cyclonic winds; while under other codes buildings must be able to withstand cyclonic winds of higher intensity.

Any bracing for building walls must satisfy a number of criteria, including:

(1) ease of installation;

(2) low cost; and (3) the ability to provide the bracing as set out in the relevant codes.

One example of the bracing for timber frame walls is disclosed in AU-B-47013/79 (534742) (TURNER) where an L-shaped metal strip has one flange received in aligned slots cut in the studs and a second flange secured, e.g., bolts, screws, nails, to the exposed faces of the studs.

In an alternative form of bracing, plywood panels are fixed, e.g., to two or three adjacent studs to brace the wall in the plane of the wall.

With respect to the first bracing method, carpenters find it annoying to have to cut the slots in the studs to install the L-shaped bracing; and the cuts reduce the structural strength of the studs. With respect to the second method, plywood panels can make it difficult to install internal or external cladding to the walls as the thickness of the plywood panels must be accommodated.

SUMMARY OF THE INVENTION

It is an object of the present invention to provide a bracing assembly which is particularly suitable for, but not limited to, providing structural bracing for walls for buildings in cyclonic areas.

It is a preferred object of the present invention to provide a bracing assembly which is pre-assembled at the factory and which can be easily installed.

It is a further preferred object of the present invention to provide a bracing assembly which has a high structural strength in the longitudinal plane of the wall.

Other preferred objects of the present invention will become apparent from the following description.

In one aspect, the present invention resides in a truss-like brace assembly for a building wall including:

a peripheral frame having a pair of substantially vertical stiles interconnected by a top member and a bottom member;

at least one diagonal brace connected to the stiles to triangulate the peripheral frame; and the stiles being fixable to respective studs in an adjacent pair of studs in the wall to provide structural bracing to the wall in a longitudinal plane thereof.

Preferably, the top member and bottom member are respectively fixable to a top wall plate and a bottom plate in the wall, the studs being interconnected by the top wall plate and the bottom plate.

Preferably, the peripheral frame is substantially rectangular in front view and is dimensional to be a close fit in a rectangular cavity in the wall defined by the studs, top wall plate and bottom plate.

Preferably, at least one substantially horizontal cross-brace interconnects the stiles, and at least one of the diagonal braces bisects the or each rectangular space in the peripheral frame defined by the stiles and an adjacent pair of the horizontal cross-braces.

Preferably, the diagonal braces are alternatively inclined in the peripheral frame, where each end of each diagonal brace is fixed to one of the stiles at a junction between the one stile and one of the cross-braces.

Preferably, the stiles, top member, bottom member, and diagonal brace(s) are of C-, L-, RHS- or SHS-metal section.

Preferably, the cross brace(s) are also of C-, L-, RHS- or SHS-metal section.

In a second aspect, the present invention resides in a wall structure for a building including:

a pair of studs, interconnected by a top wall plate and a bottom wall plate; and a brace assembly as hereinbefore described wherein:

the stiles are fixed to the studs; and the brace provides structural bracing for the wall in a longitudinal plane thereof.

Preferably, the peripheral frame is a close fit in a cavity, in the wall structure, defined by the studs, top wall plate and bottom plate;

the stiles are fixed to the studs;

the top member is fixed to the top wall plate; and the bottom member is fixed to the bottom plate.

BRIEF DESCRIPTION OF THE DRAWINGS

To enable the invention to be fully understood, preferred embodiments will now be described with reference to the accompanying drawings, in which.

DETAILED DESCRIPTION

Figure 1:
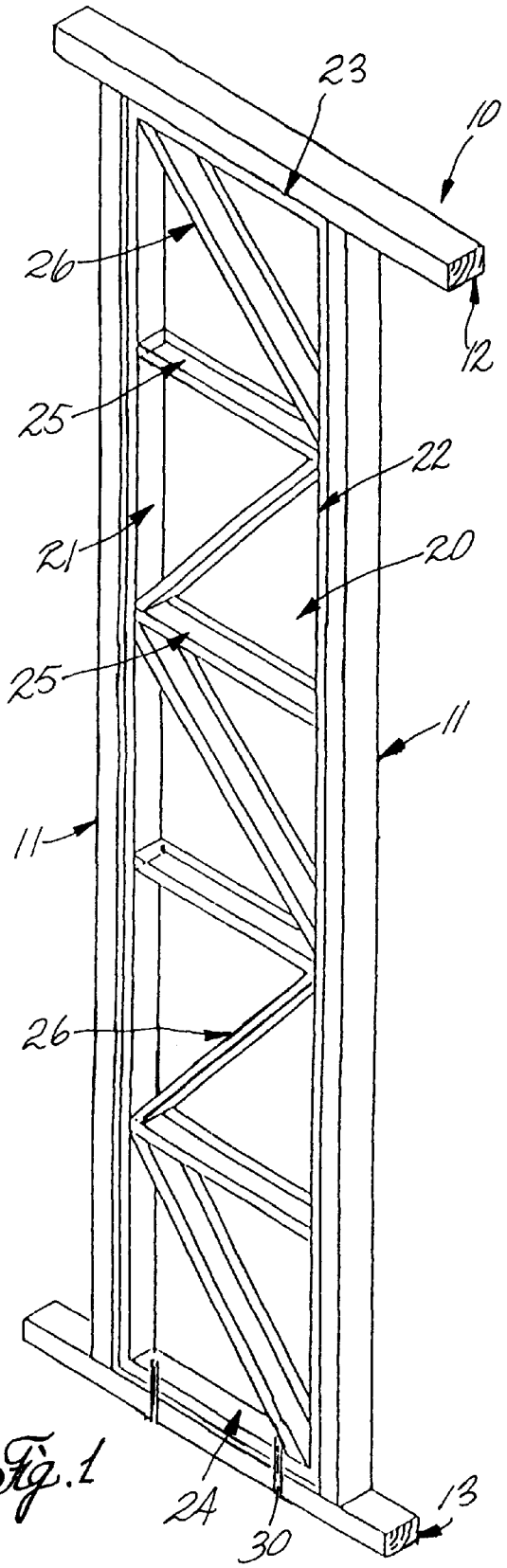
FIG. 1 is an isometric view of a portion of a building wall provided with a bracing assembly of a first embodiment of the invention.

Referring to FIG. 1, the wall structure 10 has vertical studs 11 interconnected by a top wall plate 12 and a bottom plate 13.

A brace assembly 20, in accordance with a first embodiment of the invention, is fitted within the rectangular space defined by the studs 11, top wall plate 12, and bottom plate 13.

The brace assembly 20 has a pair of vertical stiles 21, 22 interconnected by a top member 23 and a bottom member 24.

Four substantially horizontal cross-braces 25 interconnect the stiles 21, 22 and the resultant substantially rectangular spaces defined by the stiles 21, 22 and the cross-braces 25 (and top member 23 and bottom member 24) are bisected by diagonal braces 26 which are alternately inclined above the height of the brace assembly 20. It will be noted that for the intermediate diagonal braces 26, each end of the diagonal brace 26 is connected to a stile 21, 22 at the junction of the stile 21, 22 with one of the cross-braces 25.

The stiles 21, 22, the top member 23, the bottom member 24, the cross-braces 25, and the diagonal braces 26, are formed of C-section cold-rolled steel, which may be galvanized, power-coated or otherwise corrosion-proofed.

The components of the brace 20 may be welded, screwed or riveted together, and the triangulation of the brace assembly 20 by the diagonal braces 26 (in conjunction with the cross-braces 25) provides a rigid, strong, lightweight, truss-like assembly to brace the wall 10. The brace assembly 20 is fixed to the wall structure 11 by fasteners 30 (e.g., nails, screws, self-tapping screws), driven through the web portions of the stiles 21, 22, top member 23 and bottom member 24 into the adjacent studs 11, top wall plate 12 and bottom plate 13.

It will be readily apparent to one skilled in the art that the brace assembly 20 provides good structural bracing against racking loads applied to the studs 11 in the plane of the wall structure.

Figure 2:
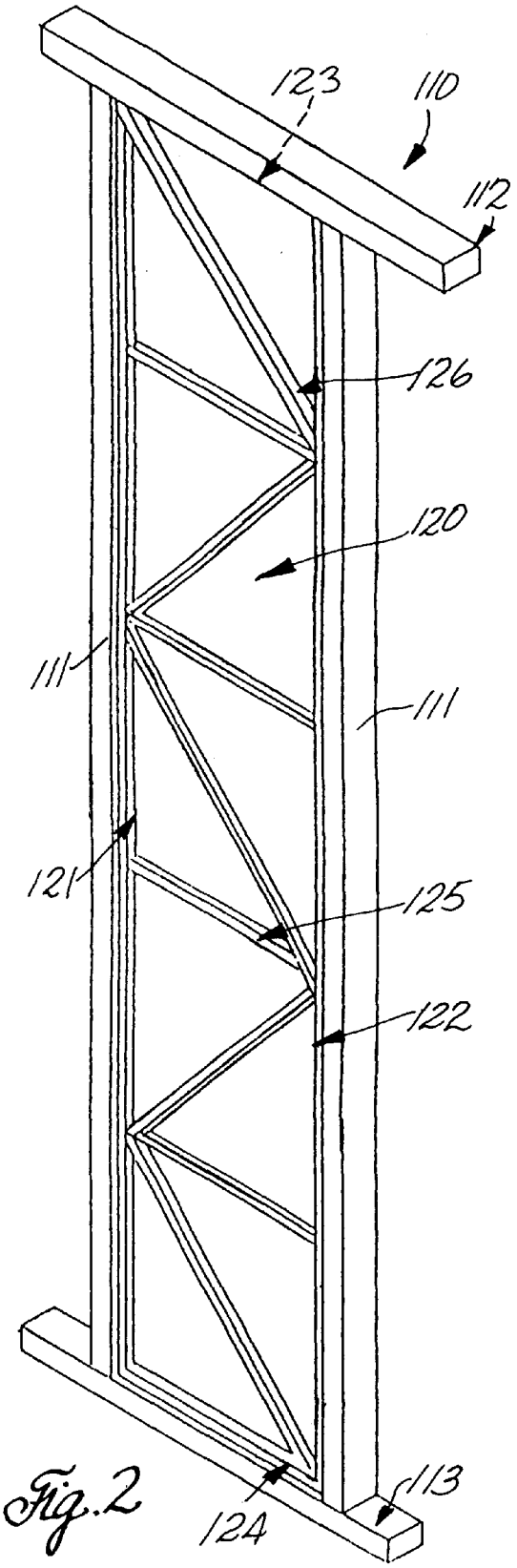
FIG. 2 is a similar view showing a second embodiment of the present invention.

Referring to FIG. 2, the wall structure 110 has studs 111, top wall plate 112 and bottom plate 113 formed from metal sections. The brace assembly 120 has a configuration substantially as hereinbefore described with reference to the brace assembly 20 except that the stiles 121, 122, top member 123, bottom member 124, cross-braces 125 and diagonal braces 126 are of square, hollow section (SHS) steel. The installation and the operation of the brace assembly 120 is as hereinbefore described.

Preferably, the brace assemblies 20, 120 are manufactured in tethered heights (e.g., to suit 2400 mm or 2700 mm stud walls) and of standard widths, e.g., to suit 450 mm and 600 mm stud spacings.

In the embodiments shown, the bottom members 24, 124 have been described as being fixed to a bottom plate. It will be readily apparent to one skilled in the art that the bottom members could be fixed directly to a concrete slab floor.

For buildings in areas where higher cyclonic loads are encountered, the external dimensions of the components, and the wall thicknesses thereof, may be increased to provide greater structural strength.

As the brace assemblies 20, 120, can be manufactured in a factory to close tolerances, they avoid on-site assembly of the bracing and enable the bracing to be easily installed and fixed in the wall structures.

Various changes and modifications may be made to the embodiments described and illustrated without departing from the present invention.

What is claimed is:

1. A truss-like brace assembly for a building wall including:

a peripheral frame having a pair of substantially vertical stiles interconnected by a top member and a bottom member;

a plurality of substantially horizontal cross-braces interconnecting the vertical stiles spaced between the top member and the bottom member;

a plurality of diagonal braces, wherein a diagonal brace bisects each space in the peripheral frame defined by the vertical stiles and an adjacent pair of horizontal cross-braces;

the peripheral frame cross-braces and diagonal braces are an integral unit, welded together and are of C, L, RHS or SHS-metal section; and the stiles being fixable to respective studs in an adjacent pair of studs in the wall to provide structural bracing to the wall in a longitudinal plane thereof to withstand cyclonic wind speeds.

2. A brace assembly according to claim 1 wherein the top member and bottom member are respectively fixable to a top wall plate and a bottom plate in the wall, the studs being interconnected by the top wall plate and the bottom plate.

3. A brace assembly according to claim 2 wherein the peripheral frame is substantially rectangular in front view and is dimensional to be a close fit in a rectangular cavity in the wall defined by the studs, top wall plate and bottom plate.

4. A brace assembly according to claim 3 wherein the diagonal braces are alternatively inclined in the peripheral frame, where each end of each diagonal brace is fixed to a respective one of the stiles at a junction between the one stile and one of the cross-braces.

5. A wall structure for a building including:

a pair of studs, interconnected by a top wall plate and a bottom wall plate;

a peripheral frame having a pair of substantially vertical stiles interconnected by a top member an a bottom member;

a plurality of substantially horizontal cross-braces interconnecting the vertical stiles and spaced from the top member and bottom member;

a plurality of diagonal braces, wherein a diagonal brace bisects each space in the peripheral frame defined by the vertical stiles and an adjacent pair of horizontal cross-braces;

the peripheral frame, cross-braces and diagonal braces are an integral unit welded together and are of C, L, RHS, or SHS-metal section;

the stiles are fixed to the studs; and the brace assembly provides structural bracing for the wall in a longitudinal plane thereof to withstand cyclonic speeds.

6. The wall structure of claim 5 wherein:

the peripheral frame is a close fit in a cavity in the wall structure defined by the studs, top wall plate and bottom plate;

the stiles are fixed to the studs;

the top member is fixed to the top wall plate; and the bottom member is fixed to the bottom plate.

7. The wall structure of claim 5 wherein the diagonal braces are alternatively inclined in the peripheral frame, where each end of each diagonal brace is fixed to a respective one of the stiles at a junction between the one stile and one of the cross-braces.

* * * * *